US005429060A

United States Patent [19]

Tokuda et al.

[11] Patent Number: 5,429,060

[45] Date of Patent: Jul. 4, 1995

[54] APPARATUS FOR USE IN BURNING PULVERIZED FUEL

[75] Inventors: Kimishiro Tokuda; Masaharu Oguri, both of Nagasaki; Fumiya Nakashima, Tokyo, all of Japan

[73] Assignee: Mitsubishi Jukogyo Kabushiki Kaisha, Tokyo, Japan

[21] Appl. No.: 183,793

[22] Filed: Jan. 21, 1994

Related U.S. Application Data

[63] Continuation of Ser. No. 819,627, Jan. 10, 1992, abandoned, which is a continuation of Ser. No. 615,851, Nov. 20, 1990, abandoned.

[30] Foreign Application Priority Data

Nov. 20, 1989 [JP] Japan ..... 1-299517

[51] Int. Cl.[6] ..... F23D 1/00

[52] U.S. Cl. ..... 110/263

[58] Field of Search ..... 110/106, 265, 347, 261, 110/263, 264, 245, 247

[56] References Cited

U.S. PATENT DOCUMENTS

| | | | |
|---|---|---|---|
| 3,387,574 | 6/1968 | Mullen . | |
| 4,150,631 | 4/1979 | Frey et al. | 110/347 |
| 4,274,343 | 6/1981 | Kokkinos | 110/106 |
| 4,294,178 | 10/1981 | Borio et al. | 110/347 |
| 4,425,855 | 1/1984 | Chadshay | 110/265 |
| 4,434,727 | 3/1984 | McCartney | 110/347 |
| 4,438,709 | 3/1984 | Borio et al. | 110/263 |
| 4,480,559 | 11/1984 | Blaskowski | 110/347 |
| 4,569,311 | 2/1986 | Llinares, Jr. | 110/263 |
| 4,570,551 | 2/1986 | Derbidge et al. | 110/347 |
| 4,669,398 | 6/1987 | Takahashi et al. | 110/265 |
| 4,715,301 | 12/1987 | Bianca et al. | 110/264 |
| 5,146,858 | 9/1992 | Tokuda | 110/347 |
| 5,195,450 | 3/1993 | Marion | 110/347 |

FOREIGN PATENT DOCUMENTS

| | | |
|---|---|---|
| 0225157 | 6/1987 | European Pat. Off. . |
| 0238907 | 9/1987 | European Pat. Off. . |
| 0385499 | 9/1990 | European Pat. Off. . |
| 61-291807 | 12/1986 | Japan . |
| 686130 | 1/1953 | United Kingdom . |
| 697840 | 9/1953 | United Kingdom . |

*Primary Examiner*—Raymond A. Nelli
*Attorney, Agent, or Firm*—Wenderoth, Lind & Ponack

[57] ABSTRACT

A structure of a boiler, of the type in which pulverized fuel is burnt within a square barrel-shaped furnace having a vertical axis, is improved so that ignitability is improved and the amount of $NO_x$ produced is decreased. Burners for injecting pulverized fuel-air mixtures are disposed at the central portions of respective edges in a horizontal cross-section of a furnace wall and are inclined downwardly with respect to a horizontal plane. Also, under air nozzles for feeding air are disposed under the respective burners.

13 Claims, 9 Drawing Sheets

APPARATUS FOR USE IN BURNING PULVERIZED FUEL

This is a continuation of now abandoned application, Ser. No. 08/819,627, filed on Jan. 10, 1992, which is a continuation of now abandoned application, Ser. No. 07/615,851, filed on Nov. 20, 1990.

BACKGROUND OF THE INVENTION

1. Field of the Invention

The present invention relates to improvements in boilers for electric utility or industrial use, furnaces for chemical industry, and the like which make use of pulverized solid fuel.

2. Description of the Prior Art

At first, one example of a boiler furnace in the prior art which makes use of pulverized coal as fuel, will be described with reference to FIG. 6 showing a vertical cross-section view, and FIG. 7 showing a horizontal cross-section view taken along line VII—VII in FIG. 6. In these figures, reference numeral 01 designates a furnace main body, numeral 02 designates burner main bodies, numeral 03 designates fuel nozzles, numeral 04 designates air nozzles for a main burner, numeral 05 designates pulverized coal transport pipes, numeral 06 designates combustion air lines, numeral 07 designates a coal pulverizer, numeral 08 designates a blower, numeral 09 designates pulverized coal-air mixture, numeral 10 designates combustion air, numeral 11 designates coal, numeral 12 designates conveying air, numeral 13 designates a furnace inner space or inner chamber, numeral 14 designates pulverized coal flames, numeral 15 designates main burner air lines, numeral 16 designates additional air lines, numeral 17 designates air for main burners, numeral 18 designates additional air, and numeral 19 designates additional air nozzles.

The above-described furnace main body 01 is formed in a square barrel-shape having a vertical axis, and as shown in FIG. 7, it is provided with burner main bodies 02 at corner portions in a horizontal cross-section of a furnace wall. Each burner main body 02 is provided with a plurality of (three in the illustrated example) assemblies each consisting of a fuel nozzle 03 and air nozzles 04 assembled above and below the fuel nozzle 03, as aligned vertically, and these fuel nozzles 03 and air nozzles 04 are all directed horizontally towards the inner space of the furnace.

Coal 11 fed to a coal pulverizer 07 is finely pulverized and mixed with conveying air (hot air) 12 which is fed simultaneously, to form pulverized coal-air mixture 09, and then the mixture sent to the burner main body 02 through pulverized coal transport pipes 05. The pulverized coal-air mixture sent to the burner main body 02 is injected to the furnace inner space 13 via the fuel nozzles 03. On the other hand, combustion air 10 is fed through combustion air lines 06 by a blower 08, then it is branched into main burner air 17 and additional air 18, and they are respectively injected to the furnace inner space 13 through air nozzles 04 provided in the burner main bodies 02 and through additional air nozzles 19 provided above the burner main bodies 02.

The pulverized coal-air mixture 09 injected to the furnace inner space 03 is ignited by an ignition source not shown, and burns while forming pulverized coal flames 13. In the pulverized coal flames 14, the pulverized coal burns, in the proximity of an ignition point, as reacting with oxygen supplied by the conveying air 12 forming the pulverized coal-air mixture 09 together with the pulverized coal as well as a part (in the proximity of the ignition point) of the main burner air 17, and thereafter in a main combustion zone, combustion is continued by oxygen in the remainder of the main burner air 17.

In a heretofore known boiler, since a total amount of the conveying air 12 and the main burner air 17 is made less than an amount corresponding to a stoichiometric ratio with respect to the pulverized coal injected through the fuel nozzles 03 for the purpose of suppressing production of nitrogen oxides (hereinafter abbreviated as $NO_x$) the furnace inner space 13 from the portion of the burner main bodies 02 up to the additional air nozzles 19 is held under a reducing atmosphere condition. Accordingly, the combustion gas produced by combustion of the pulverized coal-air mixture 09 would rise through the furnace inner space 13 initially in an incomplete combustion state, and the combustion is completed by the additional air 18 injected through the additional air nozzles 19.

Also, in the heretofore known boiler, a mixing ratio of conveying air to pulverized coal in the pulverized coal-air mixture 09 was mostly chosen in the range of 2:1 to 4:1 in weight proportion generally in view of practical use of the coal pulverizer 07. That is, the pulverized coal-air mixture 09 was subjected to combustion at a mixing ratio of [conveying air]/[pulverized coal] (hereinafter abbreviated as A/C)=2–4.

Now let us consider the problems involved in the heretofore known boilers.

[1] Generally, ignitability of the pulverized coal flames 14 is improved when the following conditions are fulfilled.

1) An amount of volatile constituent in pulverized coal is high, and a fuel ratio (fixed carbon/volatile constituent) is low;
2) A heat flow flux reaching a burner opening is large;
3) An A/C ratio of the pulverized coal-air mixture 09 is close to 1; and
4) An injection speed of the pulverized coal-air mixture 09 is slow. Accordingly, boilers satisfying the above-mentioned conditions as much as possible are considered to be favorable.

FIG. 8 is a diagram showing one example of results of practical measurements of the distribution of a heat flow flux coming from a furnace inner space 13 and reaching a furnace wall with respect to a real boiler, and FIG. 9 is a diagram showing one example of results of experiments conducted in connection with the relations between a flame propagation speed of pulverized coal and an A/C ratio of pulverized coal-air mixture. According to these diagrams, a heat flow flux coming from a furnace inner space 13 and reaching the furnace wall becomes maximum at the central portion of the furnace wall, and a flame propagation speed of pulverized coal becomes maximum at $A/C \approx 1$ of the pulverized coal-air mixture.

Since coal having a low amount of volatile constituent and a high fuel ratio does not fulfil the condition 1) above, it is desirable to fulfil the other conditions 2), 3) and 4). However, in the heretofore known boiler, since the burner main bodies 02 were provided at the respective corner portions of the furnace main body 01 as shown in FIG. 7, a heat flow flux reaching the burner portion was small as shown in FIG. 8. On the other hand, in the case of employing coal having poor ignitability due to a low volatile constituent content, it is necessary to improve the ignitability by making the A/C ratio of the pulverized coal-air mixture 09 fed to the burner main body 02 close to 1 (See FIG. 9), but in the heretofore known boiler the A/C ratio was generally 2 to 4 due to restriction in practical use of the coal pulverizer 07, and it could not be made close to 1. In addition, although the pulverized coal-air mixture 09 becomes ready to be ignited as its injection speed is slowed down in view of the relation to a flame propagation speed, as it is injected horizontally in the case of the boiler in the prior art, if the injection speed is too slow, pulverized coal in the pulverized coal-air mixture 09 would hang down and would accumulate at the fuel nozzle 03. Therefore, the injection speed cannot be made lower than a predetermined speed.

As described above, the boilers in the prior art had a shortcoming in that it was difficult to ignite coal having a low volatile constituent content or a high fuel ratio. [2] With regard to combustion in a boiler, it is a well-known fact that an amount of production of $NO_x$ is in an inversely proportional relation to an amount of charging of additional air 18. However, in the heretofore known boiler system, since there is a problem with ignitability in the case of coal having a low volatile constituent content or a high fuel ratio, the amount of charging of the additional air 18 cannot be made large, therefore, there was a limit as to the reduction of $NO_x$.

SUMMARY OF THE INVENTION

It is therefore one object of the present invention to provide an improved boiler making use of pulverized solid fuel, which is free from the above-described shortcomings in the prior art.

A more specific object of the present invention is to provide an improved boiler making use of pulverized solid fuel, in which ignitability is improved, even fuel having a low volatile constituent content and a high fuel ratio can be burnt, and the amount of $NO_x$ produced is decreased.

According to one feature of the present invention, there is provided a boiler of the type in which pulverized fuel is burnt within a square barrel-shaped furnace having a vertical axis, which comprises burners disposed at the central portions of respective sides in a horizontal cross-section of a furnace wall and adapted to inject pulverized fuel-air mixtures in downwardly inclined directions with respect to a horizontal plane, and bottom air nozzles for feeding air below the same burners.

According to the present invention, since the burners are disposed at the central portions of respective sides in a horizontal cross-section of a furnace wall, an amount of heat received by a burner opening is extremely increased. In addition, as the burners are directed in downwardly inclined directions with respect to a horizontal plane, an injection speed of a pulverized fuel-air mixture can be set slow, and a stay time of combustion gas in a reducing atmosphere zone is prolonged. Furthermore, since air is fed below the burners, combustion at the furnace bottom portion becomes good.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
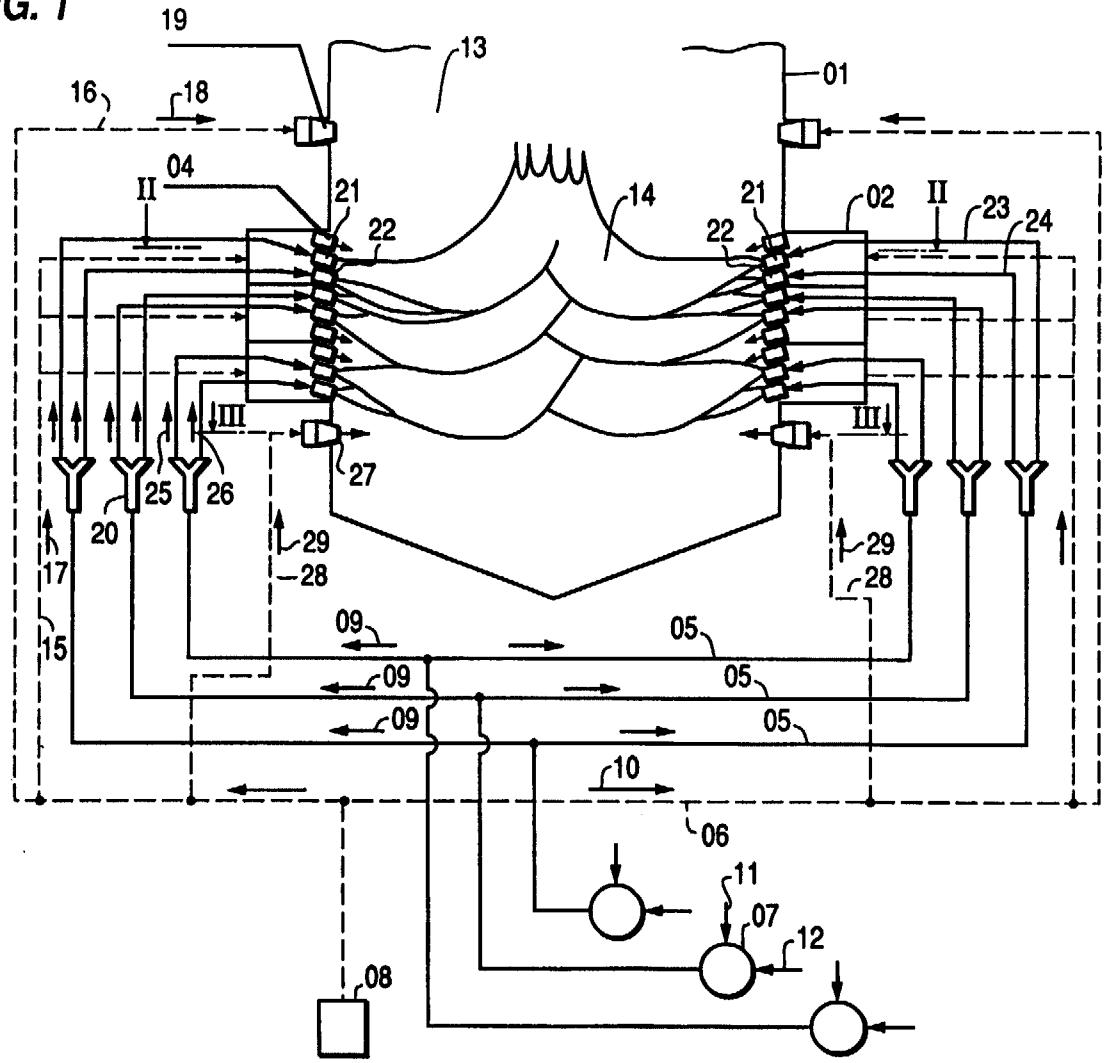
FIG. 1 is a vertical cross-section view showing a first preferred embodiment of the present invention.
Figure 6:
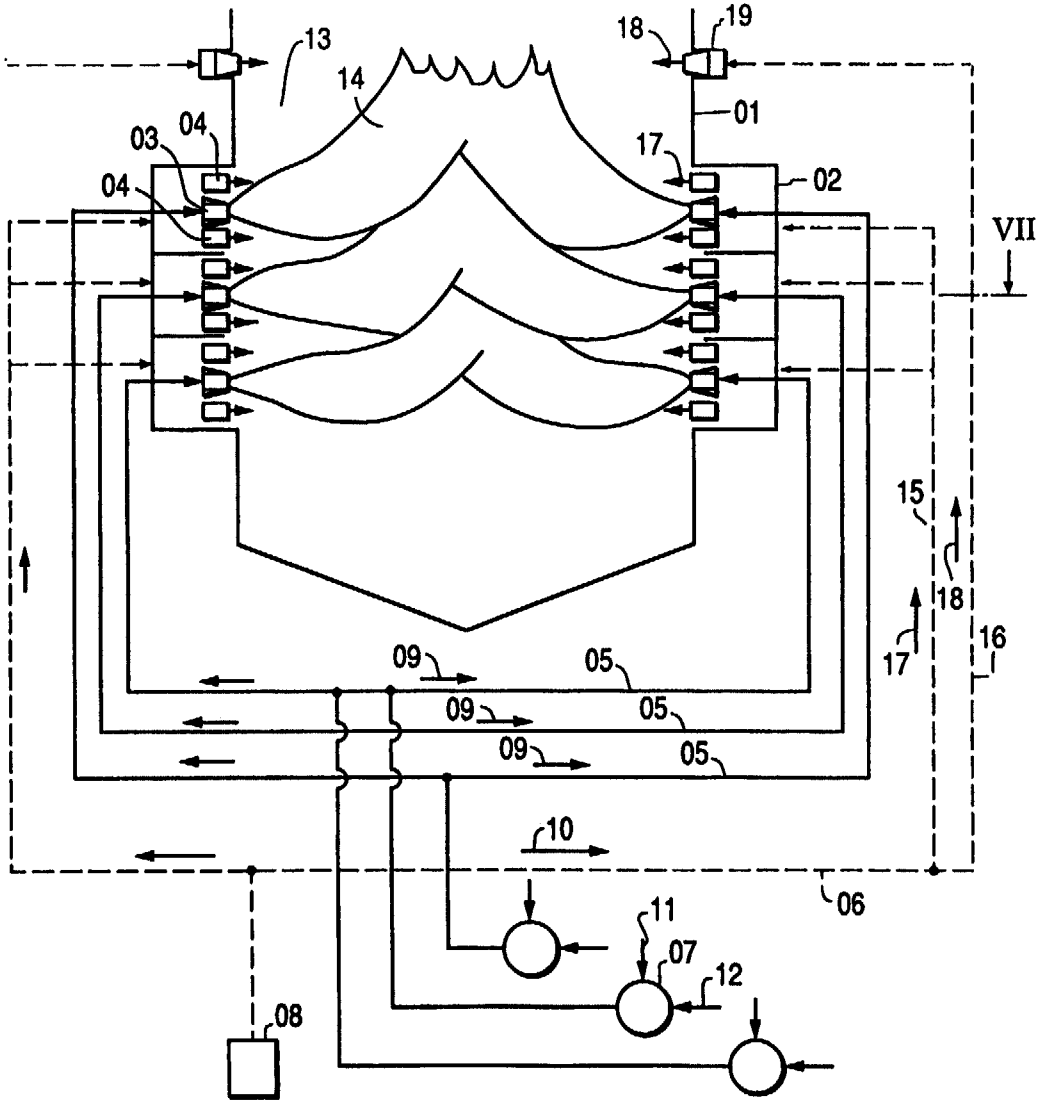
FIG. 6 PRIOR ART
FIG. 6 is a vertical cross-section view showing one example of a boiler furnace in the prior art which makes use of pulverized coal as fuel.
Figure 7:
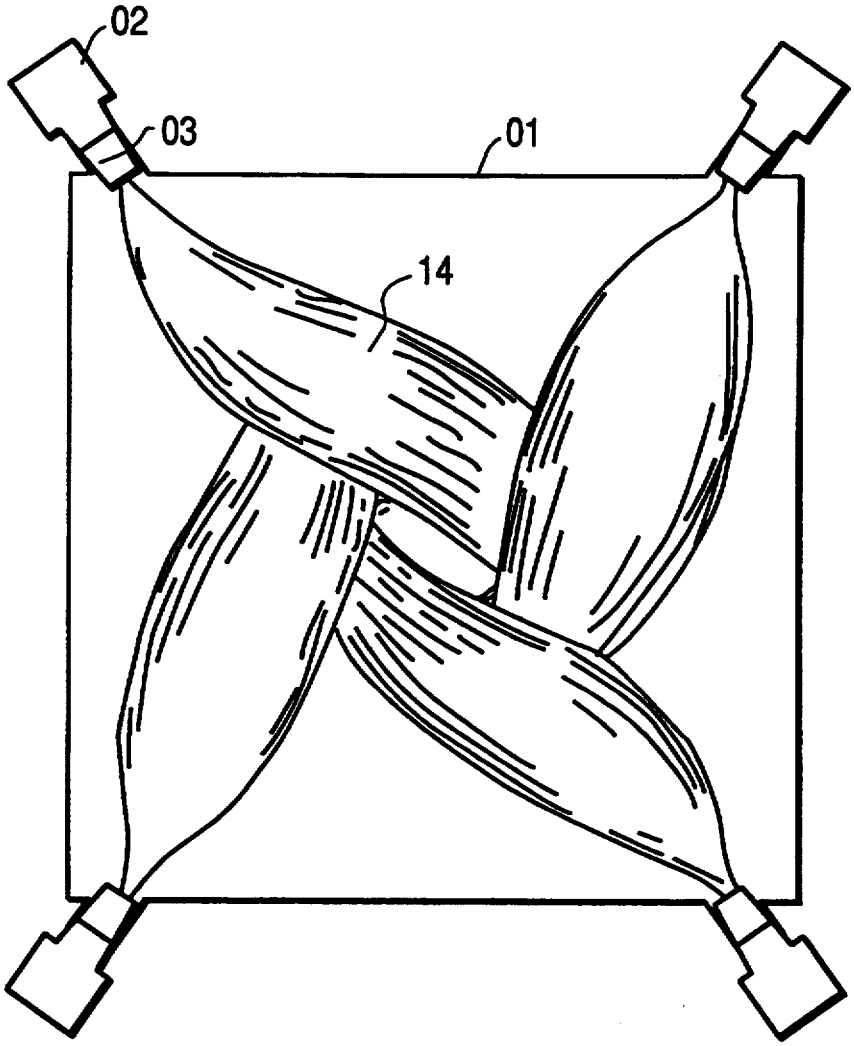
FIG. 7 PRIOR ART
FIG. 7 is a horizontal cross-section view taken along line VII—VII in FIG. 6.
Figure 8:
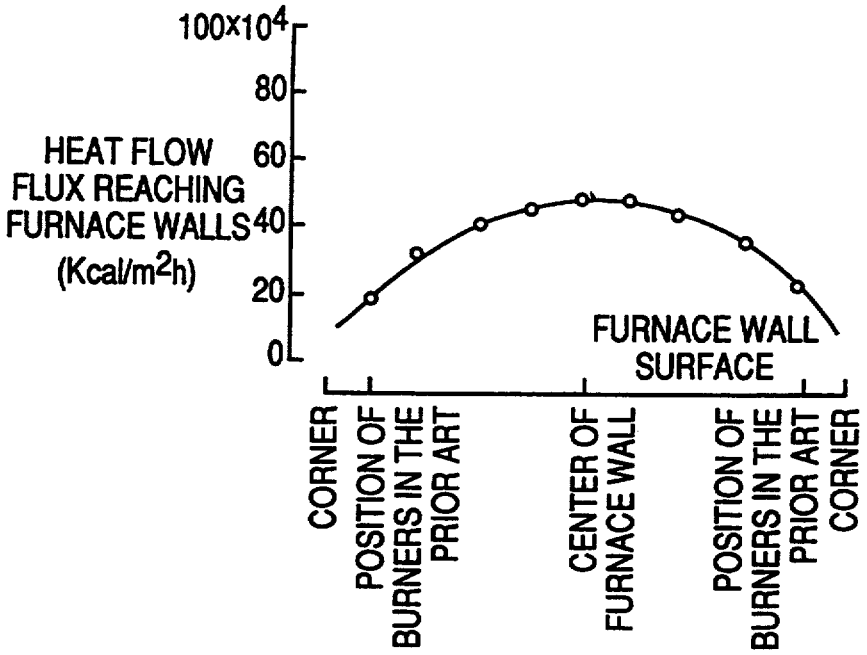
FIG. 8 is a diagram showing one example of results of measurements for distribution of heat flow flux reaching from a furnace inner space to a wall surface, conducted in a real boiler.
Figure 9:
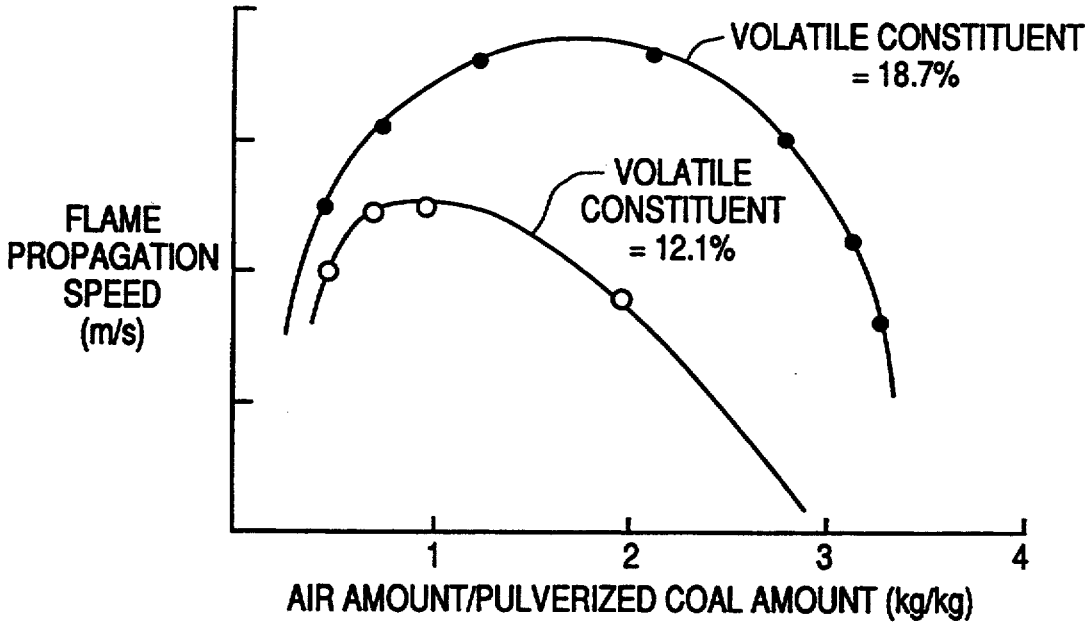
FIG. 9 is a diagram showing one example of results of experiments conducted with respect to a relation between a flame propagation speed of pulverized coal and an air-to-coal mixing ratio of a pulverized coal-air mixture.

Now, the present invention will be described in greater detail in connection with the first preferred embodiment illustrated in FIGS. 1, 2 and 3. For the purpose of avoiding redundant description, in these figures component parts similar to those of the heretofore known boiler described previously with reference to FIGS. 6 and 7, are given like reference numerals and further explanation thereof will be omitted here. As new reference numerals in FIGS. 1 to 3, reference numeral 20 designates pulverized coal separators, numeral 21 designates thick pulverized coal-air mixture nozzles, numeral 22 designates thin pulverized coal-air mixture nozzles, numeral 23 designates thick pulverized coal transport pipes, numeral 24 designates thin pulverized coal transport pipes, numeral 25 designates a thick pulverized coal-air mixture, numeral 26 designates thin pulverized coal-air mixture, numeral 27 designates bottom air nozzles, numeral 28 designates bottom air lines, and numeral 29 designates bottom air.

Coal 11 fed to a coal pulverizer 07 is finely pulverized and mixed with simultaneously fed conveying air (hot air) 12 to form a pulverized coal-air mixture 09 (A/C=2–4), and the mixture 09 is sent to the pulverized coal separators 20 through the pulverized coal transport pipes 05. Then it is separated into a thick pulverized coal-air mixture 25 ($A/C \approx 0.5$–$1.5$) and a thin pulverized coal-air mixture 26 ($A/C \approx 5$–$20$), and they are respectively sent to thick and thin pulverized coal-air mixture nozzles 21 and 22 assembled in the burner main bodies 02 through the thick pulverized coal transport pipes 23 and the thin pulverized coal transport pipes 24, respectively.

Figure 2:
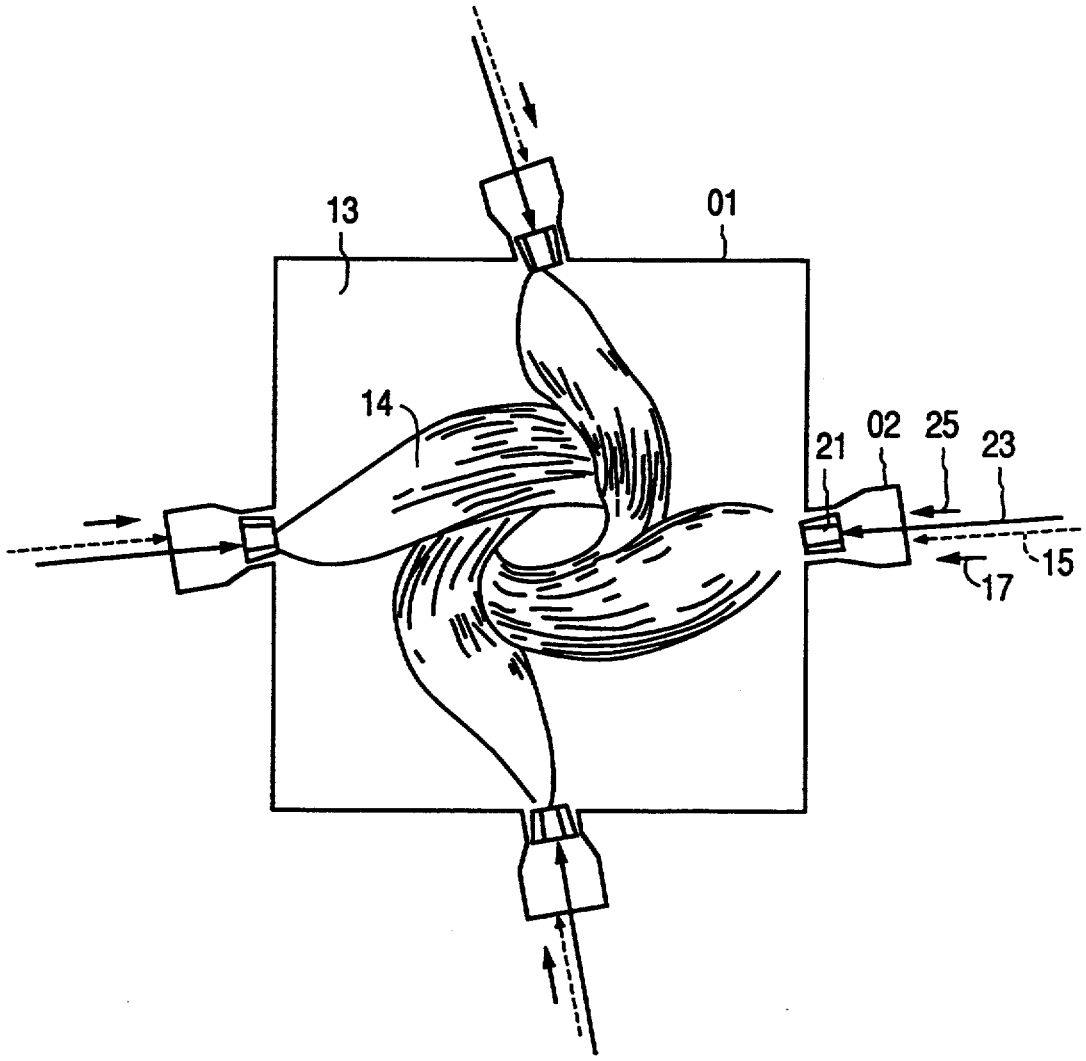
FIGS. 2 and 3 are horizontal cross-section views taken respectively along line II—II and along line III—III in FIG. 1.
Figure 3:
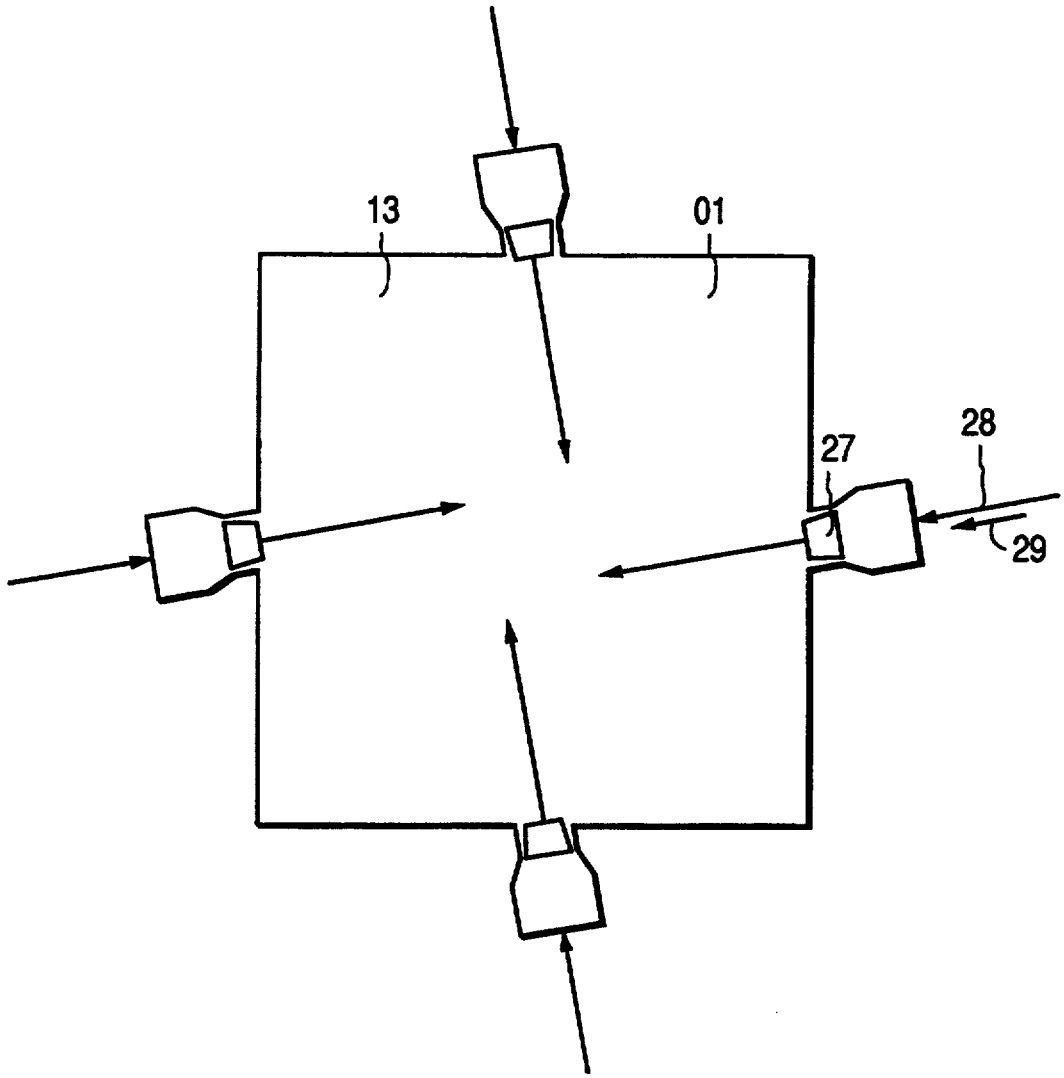

As shown in FIG. 2, the above-mentioned burner main bodies 02 are disposed at the central portions of the respective ones of the four vertical sides in a horizontal cross-section of the furnace wall of the square barrel-shaped furnace main body 01. As also shown in FIG. 2, the burners are inclined relative to a vertical plane extending perpendicular to the vertical sides to which the burners are mounted, respectively, such that the burners together define a means for supporting a substantially circular flame in the furnace inner chamber. The burner main body 02 is divided into a plurality of compartments, and each compartment is composed of both the thick and thin pulverized coal-air mixture nozzles 21 and 22 and a main burner air nozzle 04. Both the thick and thin pulverized coal-air mixture nozzles 21 and 22 are arrayed, in principle, in the sequence of thin-thick→thick-thin→thin-thick→thick-thin from the bottom or, alternatively in the sequence of thick-thin thin-thick→thick-thin→thin-thick from the bottom, but in some cases, they may be assembled in the sequence of thick-thin→thick-thin→thick-thin (or in the opposite sequence to this). These plurality of thick and thin pulverized coal-air mixture nozzles 21 and 22 are all mounted so as to be inclined downwards by 5 degrees to 45 degrees with respect to a horizontal plane, and to inject both the thick and thin pulverized coal-air mixtures 25 and 26 sent thereto into the furnace inner space or inner chamber 13. Thus, the burners collectively define an injection means for injecting the pulverized fuel-air mixture into the furnace inner chamber in a downwardly and inwardly inclined direction.

On the other hand, combustion air 10 is fed by a blower 08 through combustion air lines 06, and it is branched into main burner air 17, additional air 18 and bottom air 29. The main burner air 17 is injected into the furnace inner space 13 through the main burner air nozzles 04 assembled in the respective burner main body 02 and through the peripheral space of the both thick and thin pulverized coal-air mixture nozzles 21 and 22. The bottom air 29 is fed through the bottom air lines 28 and is blown into the furnace inner space 13 through the bottom air nozzles 27 provided separately below the burner main bodies 02. As shown in FIG. 3, the bottom air nozzles 27 are disposed at the central portions of the respective ones of four sides in a horizontal cross-section of the furnace wall so that each of their axes may be included in the same vertical plane as the axes of the corresponding burner main body 02. The total amount of the combustion air, the main burner air 17 and the bottom air 29 is made less than the amount corresponding to a stoichiometric ratio with respect to the amount of pulverized coal injected through both the thick and thin pulverized coal-air mixture nozzles 21 and 22 assembled in the burner main bodies 02, and the remainder of the air necessitated for completion of combustion is charged into the furnace inner space 13 through the additional air nozzles 19 as additional air 18.

The thick pulverized coal-air mixture 25 injected into the furnace inner space 13 is ignited by an ignition source (not shown) and forms pulverized coal flames 14. Since the thick pulverized coal-air mixture 25 has a mixing ratio $A/C \approx 0.5$–$1.5$ as described above, ignition is good and stable flames can be formed. While it is difficult to maintain flames with the thin pulverized coal-air mixture 26 simultaneously injected to the furnace inner space 13 and flames cannot be formed with only thin pulverized coil-air mixture 26 because it has a mixing ratio $A/C >> 1$ such that the concentration of pulverized coal is low, it can continue combustion by the flames of the thick pulverized coal-air mixture 25 which are formed contiguously thereto.

In addition, in the illustrated embodiment, since the burner main bodies 02 are disposed at the central portions of the respective ones of four sides of the furnace wall where heat flow fluxes coming from the furnace inner space 13 become maximum on the same horizontal cross-section of the furnace wall. The amount of heat received at the burner opening upon combustion is substantially increased as compared to the boiler in the prior art, and thus ignitability is improved.

In general, the relation of flame propagation speed and ignitability is such that, ignitability becomes better as the injection speed of the thick pulverized coal-air mixture 25 is lowered, and in this preferred embodiment, owing to the fact that the thick pulverized coal-air mixture nozzles 21 are arranged so as to be inclined downwards, hanging as well as accumulation on the pulverized coal-air mixture nozzles 21 of pulverized coal can be prevented. Thus the injection speed can be set slower than that in the case of the boiler in the prior art, and accordingly, ignitability can be further improved.

Figure 10:
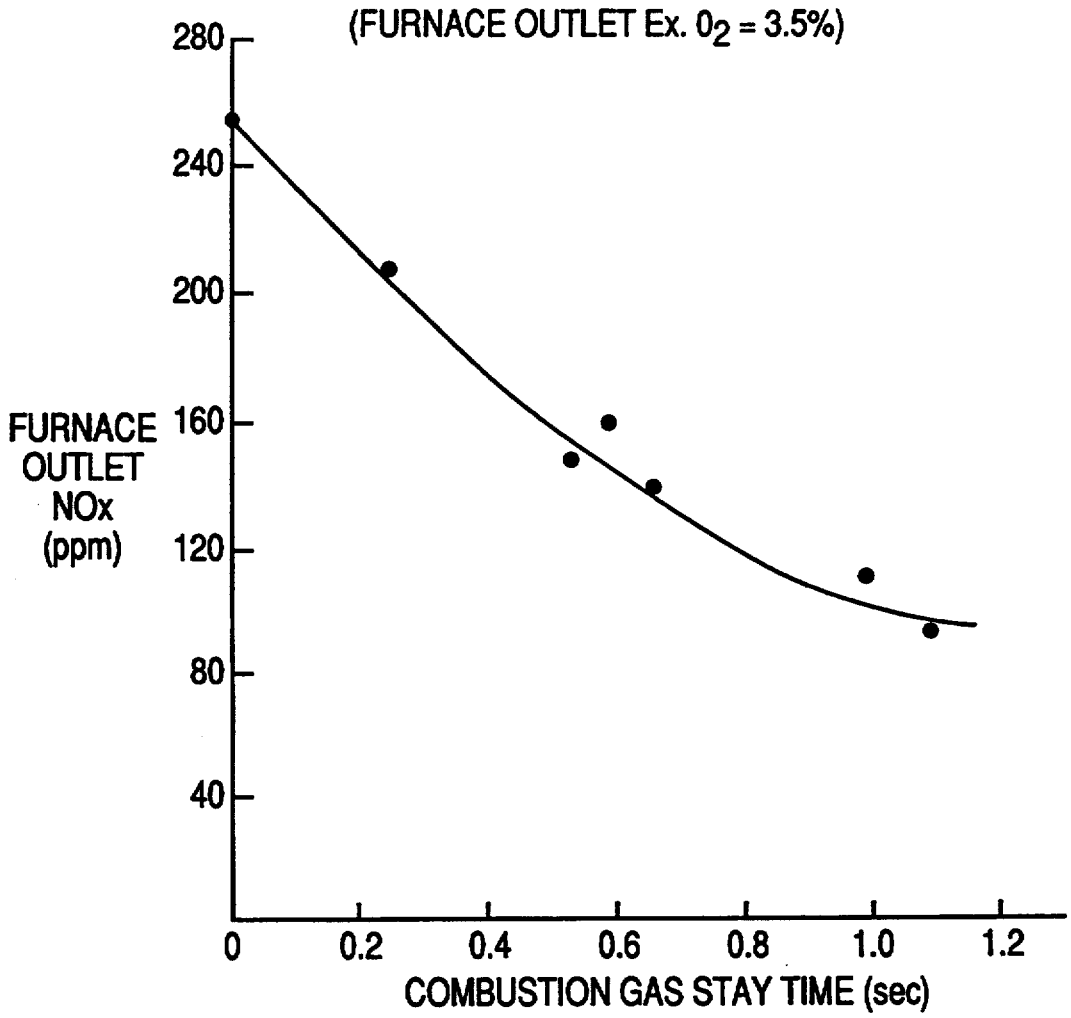
FIG. 10 is a diagram showing one example of results of practical measurements for a relation between a stay time of combustion gas in the range from the center of the burner main body to an additional air nozzle portion and an $NO_x$ concentration at the outlet of the furnace.

FIG. 10 is a diagram illustrating results of practical measurements conducted in a real system with respect to the relations between a combustion gas stay time in the range from the center of the burner main body 02 to the portion of the additional air nozzle 19 and an $NO_x$ concentration at the outlet of the furnace. In this diagram, the $NO_x$ concentration value when the additional air is not supplied is plotted the $NO_x$ concentration value at a stay time of zero. It is seen from this figure that the $NO_x$ concentration is greatly reduced by slightly extending the stay time. Since the total amount of air charged through the burner main bodies 02 and the under air nozzles 27 is less than the amount corresponding to a stoichiometric ratio with respect to the amount of pulverized coal fed through the burner main bodies 02, the furnace inner space 13 lower than the portion of the additional air nozzles 19 is a reducing atmosphere, where $NO_x$ produced by combustion of pulverized coal is reduced, and intermediate products such as $NH_3$, HCN and the like are produced. The amount of $NO_x$ at the outlet of the x furnace is determined by the extent of this reducing reaction. If the stay time is long, then a reducing reaction time is also prolonged, and accordingly $NO_x$ is decreased. In this preferred embodiment, since the pulverized coal-air mixtures 25 and 26 are injected downwardly, not only is ignitability improved as described above, but also the stay time in the furnace inner space 13 of the combustion gas is increased, and the $NO_x$ is decreased.

However, if the pulverized coal-air mixtures 25 and 26 are injected downwardly into the furnace inner space 13 held under a reducing atmosphere, there occur the following problems:

(1) Although the pulverized coal-air mixtures 25 and 26 injected from the thick and thin pulverized coal-air mixture nozzles 21 and 22, respectively, at the lowest level would form pulverized coal flames 14, since at the bottom of the furnace, a reducing atmosphere is present and a thermal load is low, the combustion product would fall under the state of charcoal (mainly a fixed carbon constituent) to the bottom of the furnace while the combustion is not proceeding sufficiently, then falls through ash discharge holes not shown into water within a clinker further below which is also not shown, and contaminates the clinker water such that it turns black.

(2) Since a melting point of ash is lowered under a reducing atmosphere as compared to the case of an oxidizing atmosphere (a well-known fact), slagging becomes remarkable, and there is a possibility that the ash discharge holes at the bottom of the furnace may become clogged.

(3) At the bottom portion of the furnace, reducing corrosion is liable to occur.

As a counter-measure against the above-mentioned problems, in this preferred embodiment, bottom air nozzles 27 are disposed under the burner main bodies 02 separately from the burner main bodies 02 in the same vertical planes as the axes of the burner main bodies 02. As the combustion of the pulverized coal-air mixtures 25 and 26 injected from the both thick and thin pulverized coal-air mixture nozzles 21 and 22 at the lowest level is promoted by the bottom air 29 fed through these under air nozzles 27 and the furnace inner space 13 under the burner main bodies 02 is held at an oxidizing atmosphere, contamination of the clinker water, clogging of the ash discharge holes at the bottom of the furnace, reducing corrosion of the bottom portion of the furnace, and the like can be prevented. Accordingly, the angle of downward inclination of both the thick and thin pulverized coal-air mixture nozzles 21 and 22 can be made large, hence a stay time within the furnace inner space 13 of the combustion gas in the range from the burner main bodies 02 to the portion of the additional air nozzles 19 is elongated by the corresponding amount, and the $NO_x$ is reduced. It is to be noted that the furnace inner space 13 lower than the portion of the additional air nozzles 19 is, as a whole, held at a reducing atmosphere.

Figure 4:
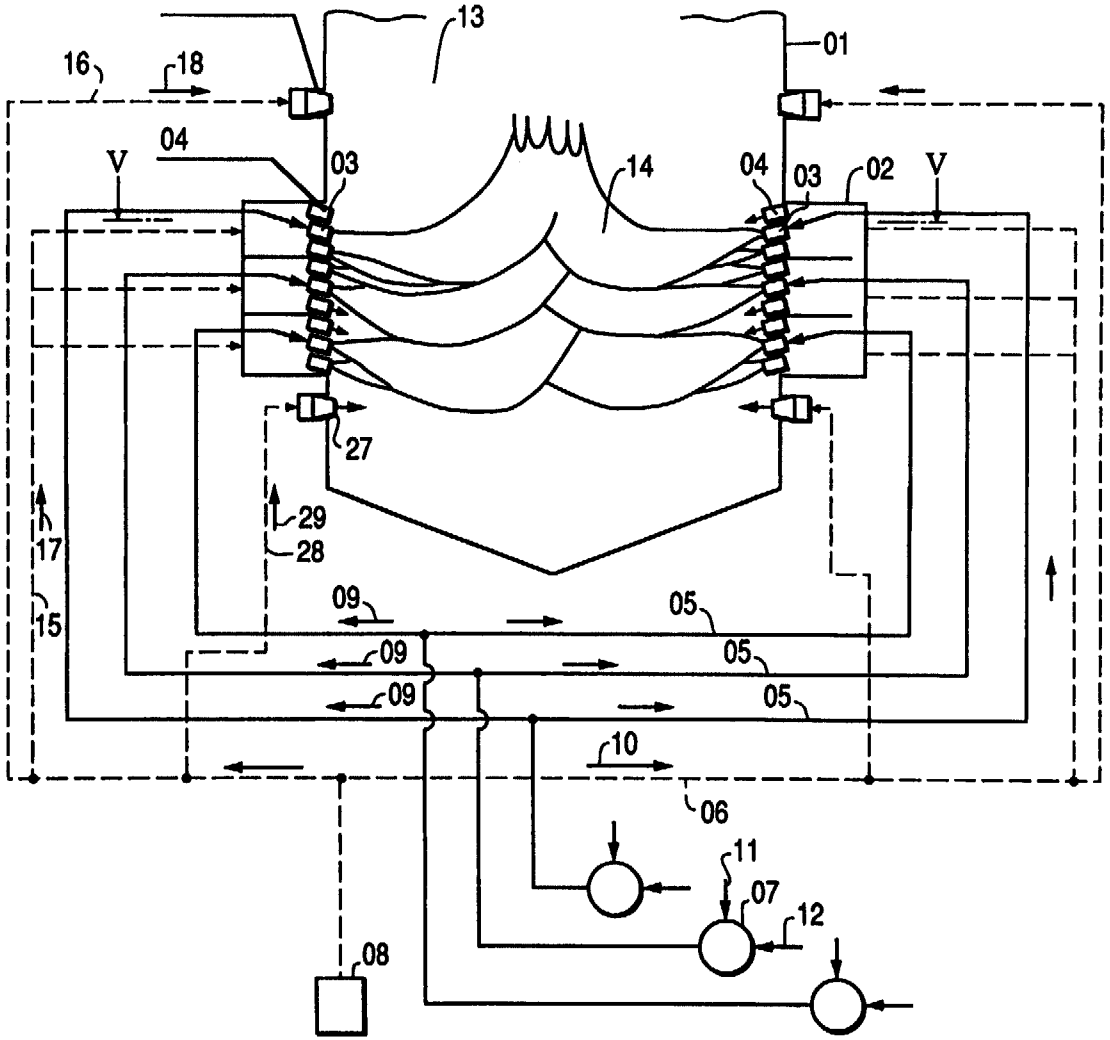
FIG. 4 is a vertical cross-section view showing a second preferred embodiment of the present invention.
Figure 5:
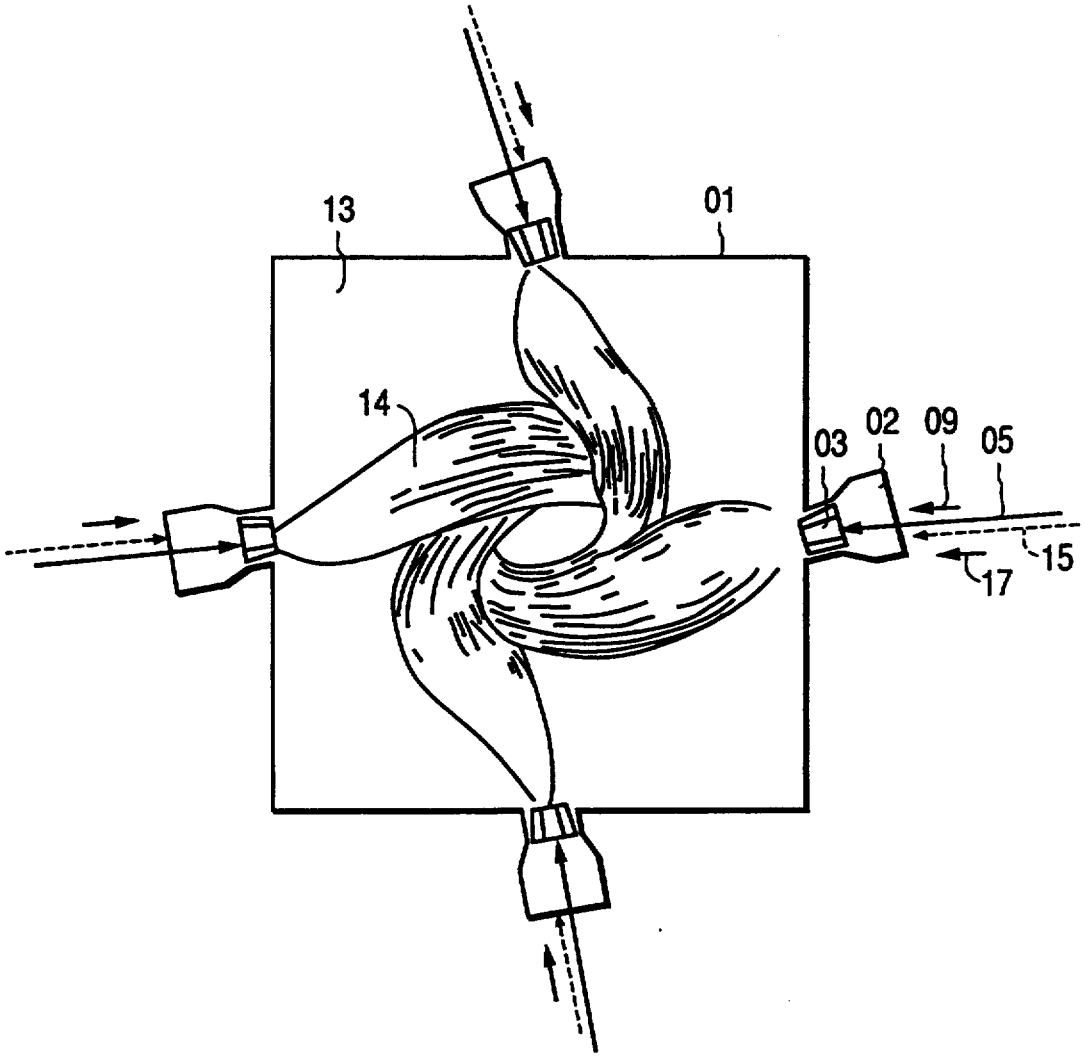
FIG. 5 is a horizontal cross-section view taken along line V—V in FIG. 4.

Next, a second preferred embodiment of the present invention will be described with reference to FIG. 4 which shows a vertical cross-section view, and FIG. 5 which shows a horizontal cross-section view taken along line V—V in FIG. 4. Also in these figures also, component parts similar to those of the first preferred embodiment described above, are given like reference numerals, and further explanation thereof will be omitted here.

In this second preferred embodiment, pulverized coal separators 20 are not present in the pulverized coal transport pipes 05 at an inlet portion of burner main bodies 20 as provided in the above-described first preferred embodiment. Accordingly, the distinction between the thick pulverized coal transport pipes 23 and the thin pulverized coal transport pipes 24 as well as the distinction between the thick pulverized coal-air mixture nozzles 21 and the thin pulverized coal-air mixture nozzles 22 are not present. Also, each pulverized coal-air transport pipe 05 is directly connected to one kind of pulverized coal-air mixture nozzle 03 disposed in the burner main body 02. The other structure is quite similar to that in the above-described first preferred embodiment.

Also in this preferred-embodiment, the burner main bodies 02 are disposed at the respective central portions of four sides in a horizontal cross-section of the furnace wall where a heat flow flux reaching from the furnace inner space 13 becomes maximum in a manner to the case of the first preferred embodiment. Thus, as described above in connection with the first embodiment, provision is made for the amount of heat received at a burner opening upon combustion to be remarkably increased as compared to the burner in the prior art.

In this preferred embodiment, since the pulverized coal separator is not provided, the A/C ratio of the pulverized coal-air mixture 09 injected to the furnace inner space 13 is normally 2–4, and this is high as compared to the A/C ratio of the thick pulverized coal-air mixture in the first preferred embodiment. However, even though this brings into question the ignitability in the case of coal having a low volatile constituent content and a high fuel ratio, due to the fact that an injection speed of the pulverized coal-air mixture 09 can be made low and an amount of heat received at the burner opening because of the downwardly inclined (5° –45° ) pulverized coal-air mixture nozzles 03, the boiler furnace has extremely excellent ignitability as compared to that in the prior art. With regard to the other operation characteristics, this modified embodiment is similar to the above-described first preferred embodiment, and there are almost equivalent advantages to the first preferred embodiment.

As will be seen from the detailed description of the preferred embodiments above, according to the present invention, the following advantages are obtained:

1) Due to the fact that the burners are disposed at the central portions of the respective sides in a horizontal cross-section of the furnace wall where a heat flow flux from the furnace inner space becomes maximum, an amount of heat received at the burner opening is extremely increased, and thereby ignitability is improved.

2) As a result of the fact that fuel nozzles (fuel-air mixture nozzles) are as inclined downwardly, an injection speed of a pulverized coal-air mixture can be set slow as compared to that in the prior art, and hence even fuel having a low volatile constituent content and a high fuel ratio which was hardly ignited in the prior art, can be properly burnt.

3) As a result of the downward inclination of the fuel nozzles, the amount of time that the combustion gas stays in the reducing atmosphere zone within the furnace becomes long. Thus, the furnace is effective for decreasing $NO_x$.

4) Thanks to feed of bottom air, combustion at the bottom portion of the furnace becomes good and an oxidizing atmosphere is formed there, so that contamination of clinker water does not occur, and sludging is also mitigated. Accordingly, the possibility of clogging of the bottom of the furnace is eliminated, and also reducing corrosion of the bottom of the furnace can be mitigated.

While a principle of the present invention has been described above in connection with preferred embodiments of the invention, it is intended that all matter contained in the above description and illustrated in the accompanying drawings shall be interpreted to be illustrative and not in a limiting sense.

What is claimed is:

1. An apparatus for use in burning pulverized fuel, comprising:

a vertical furnace having a polygon-shaped horizontal cross section so as to define a plurality of vertical furnace sides surrounding a furnace inner chamber;

injection means for injecting pulverized fuel-air mixtures into said furnace inner chamber in a downwardly and inwardly inclined direction, said injection means comprising a plurality of burners, said plurality of burners extending downwardly and inwardly toward said furnace inner chamber and being mounted to said furnace at horizontally central locations of said plurality of vertical sides, respectively;

a plurality of bottom air nozzles mounted to said furnace at positions spaced substantially below and separated from said plurality of burners, said plurality of bottom air nozzles constituting a bottom air nozzle means for feeding air into said furnace inner chamber below said plurality of burners to create an oxidizing atmosphere in a zone of said furnace inner chamber below said plurality of burners;

wherein said injection means and said bottom air nozzle means together define a means for injecting into said furnace inner chamber an amount of air which is less than an amount which would result in a stoichiometric ratio of air to pulverized coal which would support complete combustion of the amount of pulverized coal injected by said injection means;

wherein additional air nozzle means, comprising a plurality of additional air nozzles mounted above said plurality of burners, are provided for injecting an additional amount of air which will cause the total amount of air injected by said injection means, said bottom air nozzle means, and said additional air nozzle means to correspond to the stoichiometric ratio of air to pulverized coal which would support complete combustion of the amount of pulverized coal injected by said injection means; and wherein, in horizontal cross section, said burners are further inclined relative to vertical planes extending perpendicular to said vertical sides to which said burners are mounted, respectively, such that said plurality of burners together define a means for supporting a substantially circular flame in said furnace inner chamber.

2. An apparatus as recited in claim 1, wherein said polygon-shaped horizontal cross section comprises a square cross section; and said plurality of vertical furnace sides comprises four furnace sides.

3. An apparatus as recited in claim 1, wherein each of said plurality of burners comprises a plurality of compartments, each of said plurality of compartments comprising a thick pulverized fuel-air mixture nozzle means for injecting a thick pulverized fuel-air mixture into said furnace inner chamber, a thin pulverized fuel-air mixture nozzle means for injecting a thin pulverized fuel-air mixture into said furnace inner chamber, and a main air nozzle means for injecting air into said furnace inner chamber.

4. An apparatus as recited in claim 1, wherein each of said burners is inclined downwardly and inwardly toward said furnace inner chamber by 5–45 degrees relative to the horizontal, such that said injection means is operable to inject the pulverized fuel-air mixture into said furnace inner chamber at a downward incline of 5–45 degrees relative to the horizontal.

5. An apparatus for use in burning pulverized fuel, comprising:

a vertical furnace having a polygon-shaped horizontal cross section so as to define a plurality of vertical furnace sides surrounding a furnace inner chamber;

injection means for injecting pulverized fuel-air mixtures into said furnace inner chamber in a downwardly and inwardly inclined direction, said injection means comprising a plurality of burners, said plurality of burners extending downwardly and inwardly toward said furnace inner chamber and being mounted to said furnace at horizontally central locations of said plurality of vertical sides, respectively;

a plurality of bottom air nozzles mounted to said furnace at positions spaced substantially below and separated from said plurality of burners, said plurality of bottom air nozzles constituting a bottom air nozzle means for feeding air into said furnace inner chamber below said plurality of burners to create an oxidizing atmosphere in a zone of said furnace inner chamber below said plurality of burners;

pulverized coal separator means for separating, respectively, each of said pulverized fuel-air mixtures to be injected by said injection means into a thick pulverized fuel-air mixture and a thin pulverized fuel-air mixture;

wherein each of said plurality of burners comprises a plurality of compartments, each of said plurality of compartments comprising a thick pulverized fuel-air mixture nozzle means for injecting said thick pulverized fuel-air mixture into said furnace inner chamber, a thin pulverized fuel-air mixture nozzle means for injecting said thin pulverized fuel-air mixture into said furnace inner chamber, and a main air nozzle means for injecting air into said furnace inner chamber, each of said thick pulverized fuel-air mixture nozzle means and said thin pulverized fuel-air mixture nozzle means being inclined downwardly and inwardly toward said furnace inner chamber;

wherein, in horizontal cross section, said burners are further inclined relative to vertical planes extending perpendicular to said vertical sides to which said burners are mounted, respectively, such that said plurality of burners together define a means for supporting a substantially circular flame in said furnace inner chamber;

wherein said injection means and said bottom air nozzle means together define a means for injecting into said furnace inner chamber an amount of air which is less than an amount which would result in a stoichiometric ratio of air to pulverized coal which would support complete combustion of the amount of pulverized coal injected by said injection means; and wherein additional air nozzle means, comprising a plurality of additional air nozzles mounted above said plurality of burners, are provided for injecting an additional amount of air which will cause the total amount of air injected by said injection means, said bottom air nozzle means, and said additional air nozzle means to correspond to the stoichiometric ratio of air to pulverized coal which would support complete combustion of the amount of pulverized coal injected by said injection means.

6. An apparatus as recited in claim 5, wherein each of said burners is inclined downwardly and inwardly toward said furnace inner chamber by 5–45 degrees relative to the horizontal, such that said injection means is operable to inject the pulverized fuel-air mixture into said furnace inner chamber at a downward incline of 5–45 degrees relative to the horizontal.

7. An apparatus as recited in claim 5, wherein said polygon-shaped horizontal cross section comprises a square cross section; and said plurality of vertical furnace sides comprises four furnace sides.

8. An apparatus as recited in claim 5, wherein said pulverized coal separator means is operable to respectively separate said pulverized fuel-air mixtures into said thick pulverized fuel-air mixture having a ratio of conveying air to pulverized coal of 0.5–1.5 and said thin pulverized fuel-air mixture having a ratio of conveying air to pulverized coal of 5–20.

9. An apparatus for use in burning pulverized fuel, comprising:

a vertical furnace having a polygon-shaped horizontal cross section so as to define a plurality of vertical furnace sides surrounding a furnace inner chamber;

injection means for injecting pulverized fuel-air mixtures into said furnace inner chamber in a downwardly and inwardly inclined direction, said injection means comprising a plurality of burners, said plurality of burners extending downwardly and inwardly toward said furnace inner chamber and being mounted to said furnace at horizontally central locations of said plurality of vertical sides, respectively;

a plurality of bottom air nozzles mounted to said furnace at positions spaced substantially below and separated from said plurality of burners, said plurality of bottom air nozzles constituting a bottom air nozzle means for feeding air into said furnace inner chamber below said plurality of burners to create an oxidizing atmosphere in a zone of said furnace inner chamber below said plurality of burners;

wherein said injection means and said bottom air nozzle means together define a means for injecting into said furnace inner chamber an amount of air which is less than an amount which would result in a stoichiometric ratio of air to pulverized coal which would support complete combustion of the amount of pulverized coal injected by said injection means;

wherein additional air nozzle means are mounted above said burners for injecting an additional amount of air which will cause the total amount of air injected by said injection means, said bottom air nozzle means, and said additional air nozzle means to correspond to the stoichiometric ratio of air to pulverized coal which would support complete combustion of the amount of pulverized coal injected by said injection means;

wherein, in horizontal cross section, said burners are further inclined relative to vertical planes extending perpendicular to said vertical sides to which said burners are mounted, respectively, such that said plurality of burners together define a means for supporting a substantially circular flame in said furnace inner chamber; and wherein each of said bottom air nozzles is mounted to said furnace at a horizontally central location of a respective one of said plurality of vertical furnace sides, so as to be substantially aligned with a respective one of said plurality of burners along a vertical line.

10. An apparatus as recited in claim 9, wherein one of said bottom air nozzles is mounted to each of said vertical sides of said furnace on which said burners are mounted.

11. An apparatus for use in burning pulverized fuel, comprising:

a vertical furnace having a polygon-shaped horizontal cross section so as to define a plurality of vertical furnace sides surrounding a furnace inner chamber;

injection means for injecting pulverized fuel-air mixtures into said furnace inner chamber in a downwardly and inwardly inclined direction, said injection means comprising a plurality of burners, said plurality of burners extending downwardly and inwardly toward said furnace inner chamber and being mounted to said furnace at horizontally central locations of said plurality of vertical sides, respectively;

a plurality of bottom air nozzles mounted to said furnace at positions spaced substantially below and separated from said plurality of burners, said plurality of bottom air nozzles constituting a bottom air nozzle means for feeding air into said furnace inner chamber below said plurality of burners to create an oxidizing atmosphere in a zone of said furnace inner chamber below said plurality of burners;

pulverized coal separator means for separating, respectively, each of said pulverized fuel-air mixtures to be injected by said injection means into a thick pulverized fuel-air mixture and a thin pulverized fuel-air mixture;

wherein each of said plurality of burners comprises a plurality of compartments, each of said plurality of compartments comprising a thick pulverized fuel-air mixture nozzle means for injecting said thick pulverized fuel-air mixture into said furnace inner chamber, a thin pulverized fuel-air mixture nozzle means for injecting said thin pulverized fuel-air mixture into said furnace inner chamber, and a main air nozzle means for injecting air into said furnace inner chamber, each of said thick pulverized fuel-air mixture nozzle means and said thin pulverized fuel-air mixture nozzle means being inclined downwardly and inwardly toward said furnace inner chamber;

wherein, in horizontal cross section, said burners are further inclined relative to vertical planes extending perpendicular to said vertical sides to which said burners are mounted, respectively, such that said plurality of burners together define a means for supporting a substantially circular flame in said furnace inner chamber; and wherein each of said bottom air nozzles is mounted to said furnace at a horizontally central location of a respective one of said plurality of vertical furnace sides, so as to be substantially aligned with a respective one of said plurality of burners along a vertical line.

12. An apparatus as recited in claim 11, wherein one of said bottom air nozzles is mounted to each of said vertical sides of said furnace on which said burners are mounted.

13. An apparatus for use in burning pulverized fuel, comprising:

a vertical furnace having a polygon-shaped horizontal cross section so as to define a plurality of vertical furnace sides surrounding a furnace inner chamber;

injection means for injecting pulverized fuel-air mixtures into said furnace inner chamber in a downwardly and inwardly inclined direction, said injection means comprising a plurality of burners, said plurality of burners extending downwardly and inwardly toward said furnace inner chamber and being mounted to said furnace at horizontally central locations of said plurality of vertical sides, respectively;

bottom air nozzle means for feeding air into said furnace inner chamber below said plurality of burners, said bottom air nozzle means comprising a plurality of bottom air nozzles mounted to said furnace below said plurality of burners;

pulverized coal separator means for separating, respectively, each of said pulverized fuel-air mixtures to be injected by said injection means into a thick pulverized fuel-air mixture and a thin pulverized fuel-air mixture;

wherein each of said plurality of burners comprises a plurality of compartments, each of said plurality of compartments comprising a thick pulverized fuel-air mixture nozzle means for injecting said thick pulverized fuel-air mixture into said furnace inner chamber, a thin pulverized fuel-air mixture nozzle means for injecting said thin pulverized fuel-air mixture into said furnace inner chamber, and a main air nozzle means for injecting air into said furnace inner chamber, each of said thick pulverized fuel-air mixture nozzle means and said thin pulverized fuel-air mixture nozzle means being inclined downwardly and inwardly toward said furnace inner chamber;

wherein, in horizontal cross section, said burners are further inclined relative to vertical planes extending perpendicular to said vertical sides to which said burners are mounted, respectively, such that said plurality of burners together define a means for supporting a substantially circular flame in said furnace inner chamber;

wherein said injection means and said bottom air nozzle means together define a means for injecting into said furnace inner chamber an amount of air which is less than an amount which would result in a stoichiometric ratio of air to pulverized coal which would support complete combustion of the amount of pulverized coal injected by said injection means;

wherein additional air nozzle means, comprising a plurality of additional air nozzles mounted above said plurality of burners, are provided for injecting an additional amount of air which will cause the total amount of air injected by said injection means, said bottom air nozzle means, and said additional air nozzle means to correspond to the stoichiometric ratio of air to pulverized coal which would support complete combustion of the amount of pulverized coal injected by said injection means; and wherein each of said bottom air nozzles is mounted to said furnace at a horizontally central location of a respective one of said plurality of vertical furnace sides, so as to be substantially aligned with a respective one of said plurality of burners along a vertical line.

* * * * *